US008087523B2

(12) United States Patent
Kiehne

(10) Patent No.: US 8,087,523 B2
(45) Date of Patent: Jan. 3, 2012

(54) CLOSURE ASSEMBLY

(75) Inventor: Mark William Kiehne, Brisbane (AU)

(73) Assignee: Baby Bliss International Limited, Queensland (AU)

( * ) Notice: Subject to any disclaimer, the term of this patent is extended or adjusted under 35 U.S.C. 154(b) by 701 days.

(21) Appl. No.: 12/084,717

(22) PCT Filed: Nov. 10, 2006

(86) PCT No.: PCT/AU2006/001673

§ 371 (c)(1), (2), (4) Date: May 8, 2008

(87) PCT Pub. No.: WO2007/053894

PCT Pub. Date: May 18, 2007

(65) Prior Publication Data

US 2009/0255895 A1 Oct. 15, 2009

(30) Foreign Application Priority Data

Nov. 11, 2005 (AU) ..... 2005906252
Dec. 2, 2005 (AU) ..... 2005906740

(51) Int. Cl.
*A47G 19/22* (2006.01)

(52) U.S. Cl. ..... 215/11.5; 215/11.1; 220/714

(58) Field of Classification Search ..... 215/11.5, 215/11.1; 220/714, 717, 203
See application file for complete search history.

(56) References Cited

U.S. PATENT DOCUMENTS

| | | | | |
|---|---|---|---|---|
| 3,746,198 | A * | 7/1973 | Howland | 215/11.1 |
| 4,613,050 | A * | 9/1986 | Atkin et al. | 215/11.5 |
| 5,316,160 | A * | 5/1994 | Cautereels | 215/11.1 |

FOREIGN PATENT DOCUMENTS

| | | | |
|---|---|---|---|
| AU | 44399/97 | A | 2/1998 |
| AU | 4439997 | | 2/1998 |
| EP | 1354579 | | 10/2003 |
| EP | 1354579 | A1 | 10/2003 |
| GB | 2413087 | | 10/2005 |
| GB | 2413087 | A | 10/2005 |
| WO | WO 0218223 | | 3/2002 |
| WO | WO 0218223 | A1 | 3/2002 |
| WO | WO 03013418 | | 2/2003 |
| WO | WO 03013418 | A2 | 2/2003 |
| WO | WO 03055766 | | 7/2003 |
| WO | WO 03055766 | A1 | 7/2003 |

* cited by examiner

*Primary Examiner* — Anthony Stashick
*Assistant Examiner* — Cynthia F Collado
(74) *Attorney, Agent, or Firm* — Defillo & Associates, Inc.; Evelyn A. Defillo

(57) ABSTRACT

A closure assembly (11) for a baby's bottle (10) comprising a regulator cap (16) which is adapted to be mounted to the bottle (10) and having one or more apertures (22), a teat collar (17) threaded to the bottle and moveable between an open and closed position and a teat (18) coupled to the teat collar (17) and having an outlet (45) for passage of fluid, the teat having (17) a base flange (38) adapted for cooperation with the regulator cap (16) such that in the open position of said teat collar (17) fluid can pass through the one or more apertures (22) and through the teat outlet (45) and air can pass between the base flange (38) and regulator cap (16) into the bottle (10) through one or more of the apertures (22). In the closed position, fluid is prevented from passage through the one or more apertures (22) into the teat (16) and air is prevented from passing between the base flange (38) and regulator cap (16) into the bottle (10).

20 Claims, 6 Drawing Sheets

CLOSURE ASSEMBLY

CROSS REFERENCE TO RELATED APPLICATION

This application is a national stage entry of PCT/AU2006/001673 filed Nov. 10, 2006, under the International Convention claiming priority over Australian application No. AU 2005906252 filed Nov. 11, 2005 and Australian application No. AU 2005906740 filed Dec. 2, 2005.

TECHNICAL FIELD

The present invention relates to closure assemblies and in particular a closure assembly for a baby's bottle or other like container. The present invention also relates to a baby's bottle incorporating an improved closure assembly.

BACKGROUND ART

A baby's bottle normally has a closure system which consists of a screw-on cap having a teat or nozzle. A baby sucking on the teat is able to withdraw milk or other liquid inside the bottle. A baby drinking from a bottle as described above frequently encounters the problem of colic which occurs when milk or other liquid and air is ingested by the baby at the same time.

The problem with some existing babies bottles is that the bottle cap with the teat cannot prevent air passing in through the hole in the teat to the interior of the bottle. Such a flow of air occurs automatically due to the partial vacuum which is created in the nozzle when the baby sucks milk through the hole in the teat thus creating the risk of colic. Known closure assemblies also often leak liquid from the bottle.

SUMMARY OF THE INVENTION

The present invention aims to provide an improved closure assembly and in particular a closure assembly for a baby's bottle or other container. The invention in a particular aspect aims to provide a closure assembly for a baby's bottle which when applied to a baby's bottle is able to reduce air being sucked through the hole in the teat along with milk or other liquid. The present invention in a further aspect aims to provide a closure assembly having a closure part which may be rotated between and open and closed position. Other objects and advantages of the invention will become apparent from the following description.

According to a preferred aspect of the present invention, there is provided a closure assembly for a baby's bottle, said closure assembly comprising a regulator cap which is adapted to be mounted to said bottle, said regulator cap having one or more apertures therein, a teat collar locatable over the regulator cap, said teat collar being moveable between an open position and a closed position, and a teat coupled to the teat collar and having an outlet for passage of fluid, said teat having a base flange adapted for cooperation with said regulator cap such that when said teat collar is in said open position, fluid can pass through one or more said apertures in said regulator cap and through said teat outlet and air can pass between said base flange and said regulator cap into said bottle through one or more said apertures and wherein when said teat collar is in said closed position, fluid is substantially prevented from passage from said one or more aperture in said regulator cap into the said teat and air is prevented from passing between said base flange and said regulator cap into said bottle.

Reference throughout the specification and claims is made to a closure assembly for a baby's bottle. It will be appreciated however that the closure assembly has other applications and thus the terms "bottle" and "baby's bottle" used herein includes liquid containers of any form and the term "teat" includes any form of flexible nipple or nozzle.

Preferably the base flange is adapted to permit air to enter the bottle through the one or more apertures in the regulator cap when the teat collar is in the open position and when a suction pressure exists within the bottle due for example a suction pressure being applied to the teat. The teat typically is formed of a flexible material such as a rubber material or a synthetic plastics material.

Preferably the teat includes a main central body and has the base flange located at the base of the body. Preferably the base flange includes an annular sealing rib on its underside adapted to cooperate with the regulator cap. The annular sealing flange may flex to act as a flap-like valve member. Preferably the teat has an annular groove in its periphery between the base flange and main body. Preferably the outer peripheral portion of the base flange has a raised inwardly directed shoulder. Preferably the base flange tapers outwardly from said shoulder.

Preferably the regulator cap includes an annular rim adapted for cooperation around its periphery with the annular sealing rib of the teat base flange. The annular sealing rib of the base flange is suitably adapted to be located inwardly of the annular rim.

Preferably the annular sealing rib is adapted to flex away from the annular rim upon suction pressure being applied to the nozzle. Preferably also the base flange is adapted to seat on the annular rim. Suitably air is able to pass between the base flange and rim upon a suction pressure being applied to the nozzle. In the absence of suction pressure, the base flange and/or annular rib suitably seal against the annular rim.

The regulator cap may be configured to be a push or press fit into a mouth of the bottle to which the closure assembly is applied. Preferably for this purpose, the regular cap includes an annular flange which is receivable within the mouth of the bottle to frictionally engage the inner surface of the mouth such that the regulator cap is secured and sealed to the bottle. Preferably, the annular flange is tapered at its free end to facilitate placement into the bottle mouth.

Preferably the teat collar has a central opening through which the teat may project and a side wall or skirt, the side wall or skirt having a thread, suitably a female thread, on its inside surface for cooperation with an external thread, suitably a male thread, on the bottle adjacent the mouth of the bottle.

Alternatively the male thread may be provided on the inside surface of the side wall or skirt of the teat collar and the female thread is provided on or in the outer side wall of the bottle. The teat collar suitably has annular rib on its underside coaxial with the central opening. Preferably the annular rib is located radially outwardly of the opening.

Preferably the region of the teat collar adjacent the opening is adapted to be captured in the annular groove of the teat. Preferably the annular groove in the teat is of a width substantially the same as the distance between the top of the teat collar and the lower end of the annular rib. Preferably the annular rib is adapted to abut the shoulder on the base flange of the teat. Preferably the annular rib is positioned radially inwardly of the annular rim of the regulator cap.

The closure assembly may include stop means for providing a resistance to turning of the teat collar when it has been turned or rotated a predetermined distance. The stop means may comprise a radial enlargement on the inside of the side wall or skirt of the teat collar. Preferably the stop means on the collar are adapted for cooperation with stop means on the bottle. The stop means on the bottle suitably comprises a radial enlargement on the neck of the bottle.

Preferably the stop means are suitably adapted to abut each other when the teat collar has been rotated the predetermined distance. Preferably the stop means comprises pairs of stop members on the collar and bottle, abutment between the stop members defining the open and closed position of the closure assembly.

Preferably the stop members on the collar and bottle are arranged at 180 degrees to each other. Preferably the stop members are formed such that increased rotational force applied to the teat collar or bottle will cause the stop members to move beyond their position of abutment so as to enable the teat collar to be detached from the bottle.

In the closed position of the closure assembly, it is preferred that the annular rim of the regulator cap is forced into sealing engagement with the underside of the base flange. Furthermore in the closed position it is preferred that the annular sealing rib is forced into sealing engagement with the rim to prevent escape of liquid from the bottle and/or entry of air into the bottle. Preferably deflection of the base flange causes the annular sealing flange to be forced into abutment with the annular rim. Suitably the base flange is deflected by a downward force applied by the annular rib on the teat collar.

Preferably the teat has an entrance leading into an upper chamber portion thereof, the entrance being closed by the regulator cap in the closed position of the closure assembly. The regulator cap may include a plug-like member which extends into and closes the entrance in the closed position of the closure assembly. The plug-like member may comprise a dome-shaped member on the regulator cap suitably provided centrally on the regulator cap.

Preferably also the regulator cap includes a flange or flanges which extend/s upwardly of the plug-like member of the regulator cap. The flange or flanges assist in restricting detachment of the teat from the teat collar. The flange or flanges suitably extend radially of the regulator cap. The flange or flanges may be in a cruciform configuration in plan view. The flanges suitably extend to a position, or are arranged adjacent to the inner surface of the teat adjacent the entrance of the nozzle.

Preferably the teat collar includes a gripping portion on an external surface thereof to facilitate its gripping and rotation in opposite directions by hand. It is preferred that the teat collar is able to rotate to the open position whereby fluid is able to flow through the opening or openings in the regulator cap for passage to the teat.

The regulator cap and teat collar are preferably formed of a relatively rigid plastics material but may be formed of other materials. The teat may be formed of a resilient material such as silicone rubber or latex. The bottle is preferably a bottle for containing a liquid such as milk or juice.

BRIEF DESCRIPTION OF THE DRAWINGS

In order that the invention may be more readily understood and put into practical effect, reference will now be made to the accompanying drawings which illustrate a preferred embodiment of the invention. The description of the preferred embodiment relates to a closure assembly for a baby's bottle however it will be appreciated that the closure assembly may be applied to other liquid containers. In the drawings:—

DETAILED DESCRIPTION OF THE DRAWINGS

Figure 1:
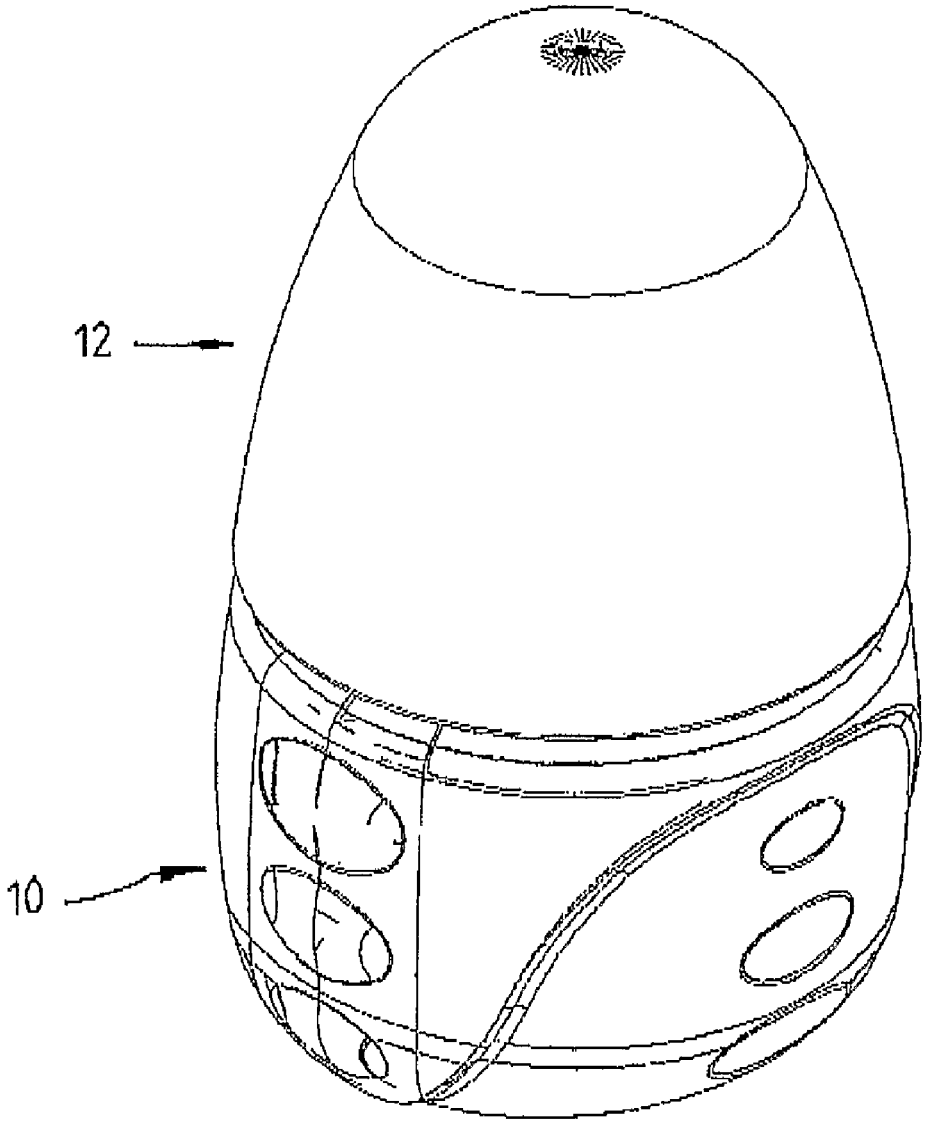
FIG. 1 illustrates a baby's bottle provided with a closure assembly according to an embodiment of the invention.
Figure 2:
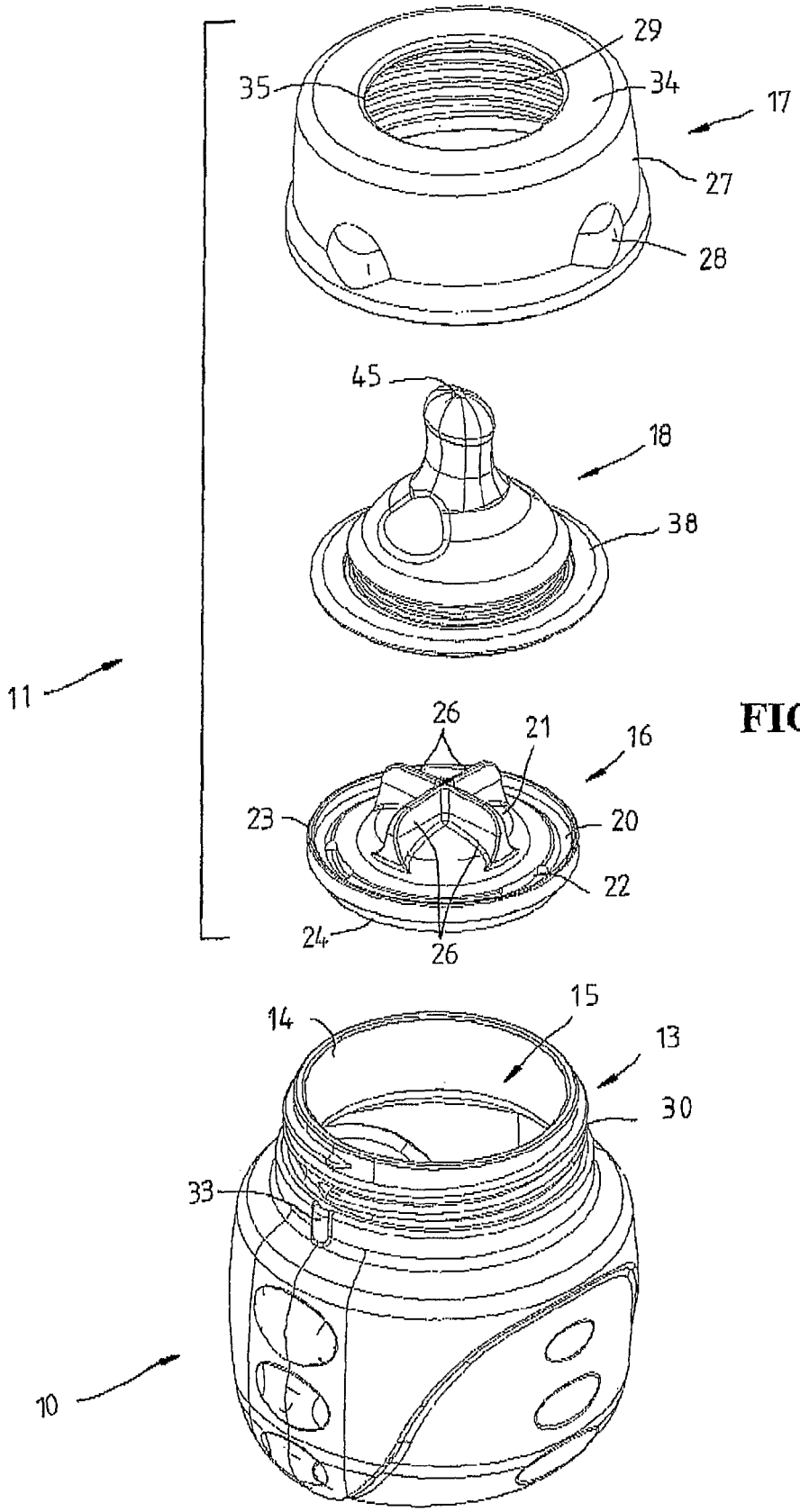
FIG. 2 is an exploded view of the baby's bottle of FIG. 1 and closure assembly.

Referring to the drawings and firstly to FIGS. 1 and 2, there is illustrated a baby's bottle 10 having a closure assembly 11 according to the present invention which in FIG. 1 is shown covered by a cap 12 which clips onto the bottle 10 or closure assembly 11. The bottle 10 may be formed of glass or plastics material and has an externally threaded neck 13, the neck 13 having an inner cylindrical surface 14 which defines the mouth or outlet 15 of the bottle 10.

Figure 3:
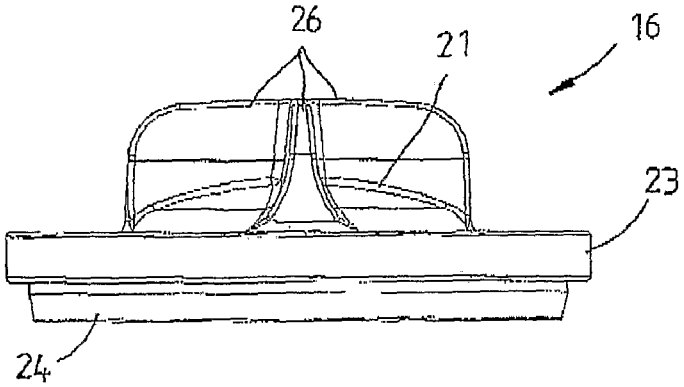
FIGS. 3 and 4 are side and top views respectively of the regulator cap of the closure assembly.
Figure 4:
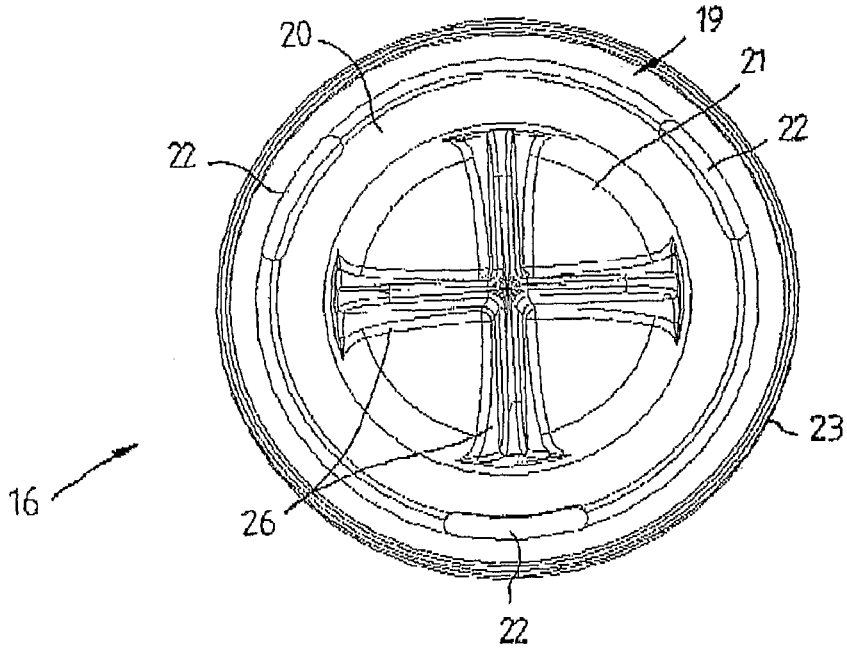
Figure 9:
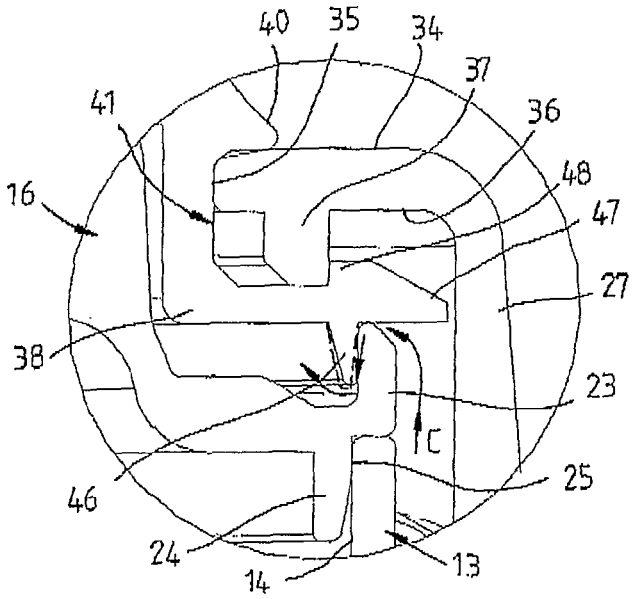
FIG. 9 is an enlarged view of the region A of FIG. 8.
Figure 10:
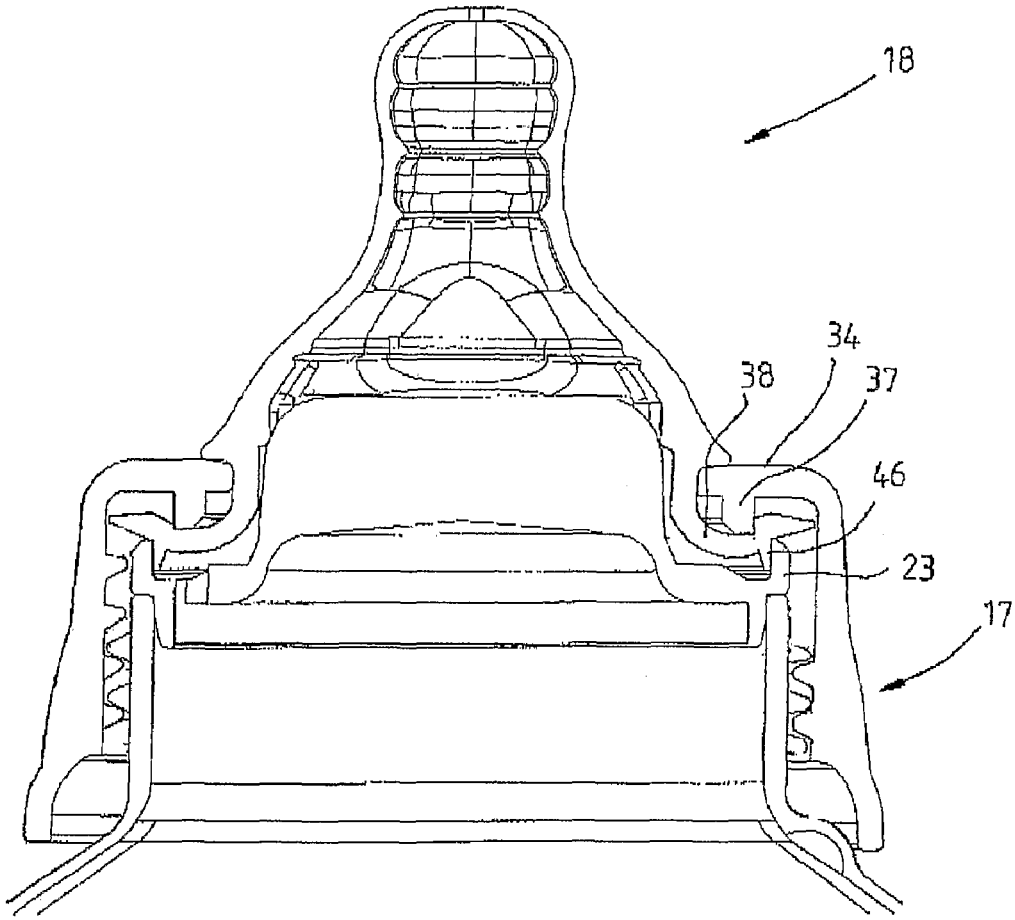
FIG. 10 is a sectional view of the closure assembly in a closed position.

The closure assembly 11 comprises a regulator cap 16, a teat collar 17 and a teat or nipple 18. The regulator cap 16 also shown in FIGS. 3 and 4 is of circular configuration in plan view and has a top wall 19 comprising an annular outer wall portion 20 and a central dome 21 projecting upwardly therefrom. Three equispaced circumferentially extending apertures or slots 22 are formed through the annular portion 20 around the dome 21. The regulator cap 16 additionally includes on its upper side and at the outer periphery of the wall portion 20, a thin annular rim 23 which extends upwardly from the wall portion 20, the annular rim 23 tapering in its width towards its free upper edge as illustrated in FIG. 9.

A further annular rib or flange 24 is provided on the lower side of the top wall 19 radially inwardly of the annular rim 23. The rib or flange 24 has a maximum diameter region 25 adjacent the underside of the wall 19 and tapers in width towards its free edge thereof as shown in FIG. 9. The maximum diameter region 25 of the rib 24 is substantially the same as or slightly greater than the inner diameter of the mouth 15 of the bottle 10 defined by the surface 14 so that the rib 24 of the regulator cap 16 can be forced into the mouth 15 and frictionally and sealingly engage with the internal wall 14. The tapering free end of the rib 24 facilitates the forcing of the rib 24 into the container mouth 15 for sealing against the inner wall 14. The regulator cap 16 however can be removed to allow filling of the bottle 11.

The regulator cap 16 additionally is provided with flanges 26 on its upper side which extend upwardly of the dome 21, the flanges 26 being in a cruciform configuration in plan view and extending diametrically of the regulator cap 16. The flanges 26 lie in planes passing through and extending parallel to the longitudinal axis of the closure assembly 11.

Figure 5:
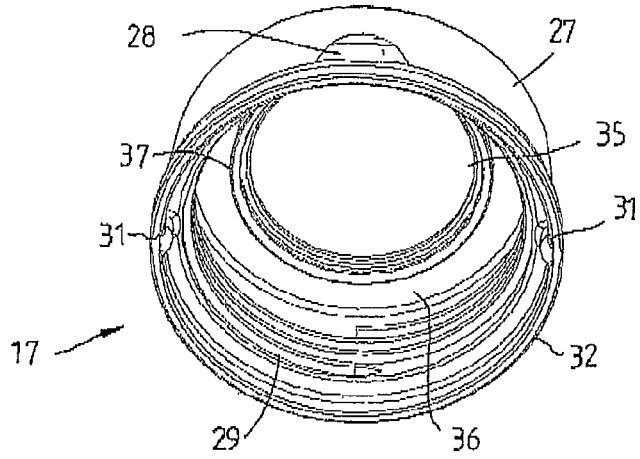
FIGS. 5 and 6 are underside views of the teat collar of the closure assembly.
Figure 6:
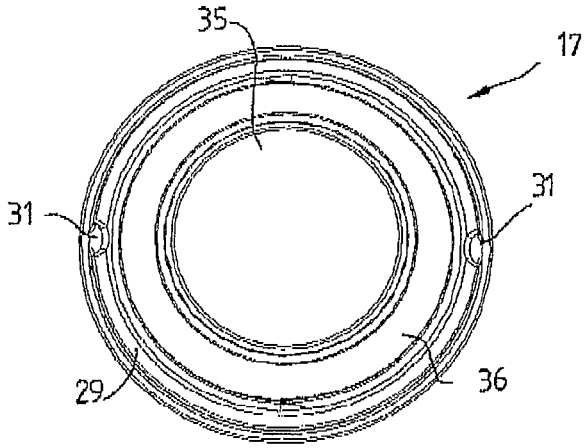

The teat collar 17 as also shown in FIGS. 5 and 6 has an outer side wall or skirt 27 which has castellations or other projections 28 at spaced positions around its periphery assist with gripping and turning. The inside surface of the wall 27 of the teat collar 17 is provided with a thread 29 which is adapted for complementary engagement with the thread 30 of the bottle neck 13. In addition a pair of radially enlarged stop members 31 are provided at a 180 degree spacing on the inner side of the wall 27 adjacent the lower edge 32 thereof. The stop members 31 are adapted for engagement with corresponding stop members 33 formed or moulded on the outer surface of the bottle neck 13 beneath the thread 30 and in the path of rotation of the stop member 31 when the collar 17 is threaded onto the neck 13. Cooperation between the respective stop members 31 and 33 will prevent or limit rotation of the teat collar 12 relative to the bottle 10 in opposite directions with abutment between the stop members 31 and 33 defining open and closed states of the closure assembly 11. The stop members 31 and 33 are of domed or curved cross sectional configuration in the embodiment but may be of many different configurations.

The top surface of the top wall 34 of the teat collar 17 is generally flat with a central circular opening 35 therethrough. The wall 34 has a substantially planar lower surface 36 and an annular rib 37 extending downwardly therefrom in the direction of the wall or skirt 27, the rib 37 being spaced radially outwardly from the opening 35.

Figure 7:
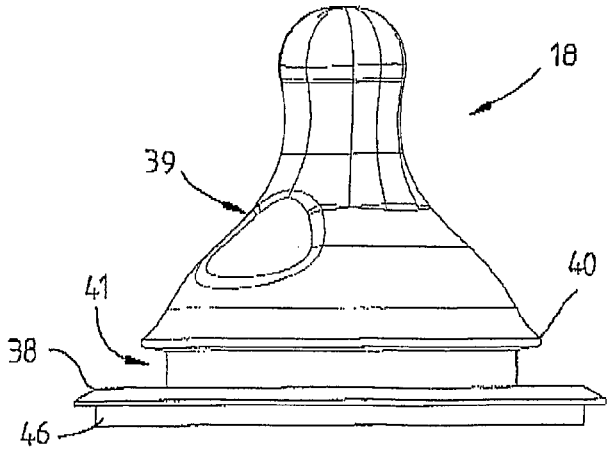
FIG. 7 is a side view of the teat of the closure assembly.
Figure 8:
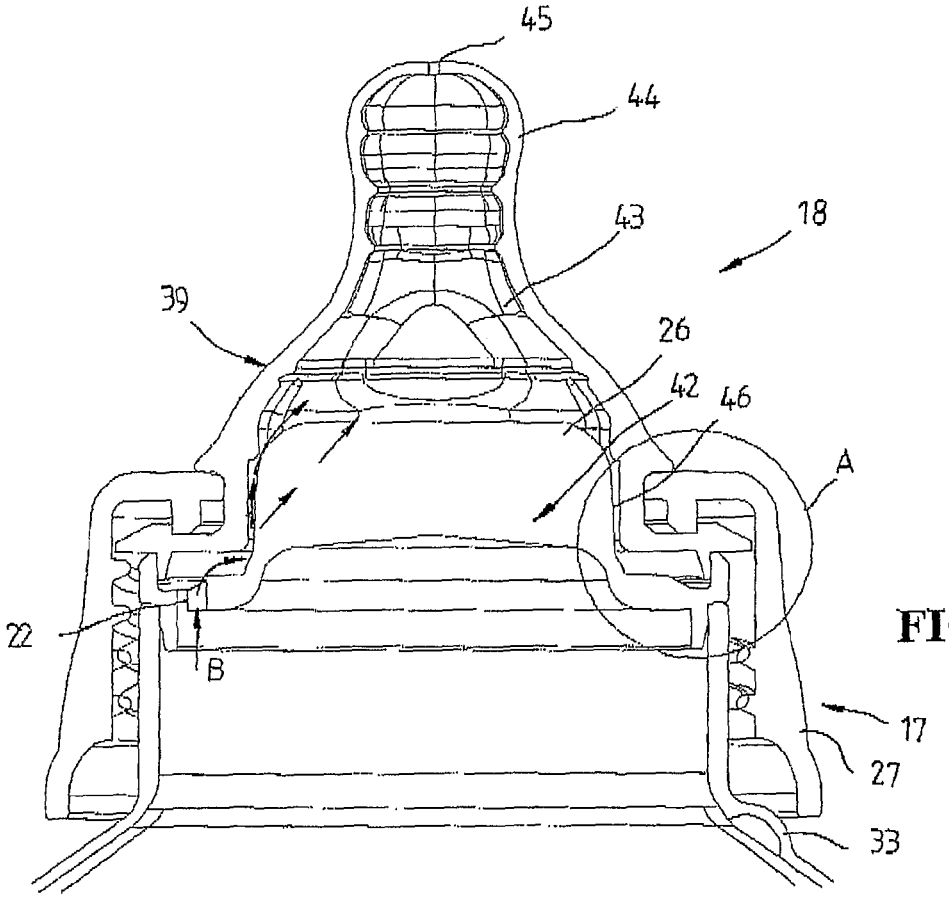
FIG. 8 is a sectional view of the closure assembly in an open position.

The teat 18 as shown also in FIGS. 7 to 9 is made of a resilient plastic or rubber material such as silicon rubber or latex and has an annular base flange 38, and a coaxial hollow main teat body 39 extending upwardly from and formed integrally with the flange 38, the teat body 39 having a collar 40 at its lower end spaced above the base flange 38 and defining an undercut annular groove 41 which is of a width a distance substantially the same as the distance between the top surface of the wall 34 and the free lower end of the annular rib 37 of the teat collar 17. The annular groove 41 has an inner diameter substantially the same as or slightly greater than the diameter of the opening 35 in the teat collar 17.

The teat body 39 has an entrance 42 of an internal diameter substantially the same or slightly less than the diameter of the dome 21 so that the latter may project into the entrance 42 in the closed position of the closure assembly 11 and act as a plug to sealingly engage with the entrance 42. The entrance 42 leads into an upper chamber 43 within and defined by the teat body 39. The teat body 39 tapers to a nozzle 44 having one or more outlets 45 therein.

The base flange 38 comprises a relatively thin flexible member and a thin annular sealing rib or flange 46 is integrally formed with the annular base flange 38 on the underside of the flange 38 and coaxially thereof. The rib 46 has an outer diameter substantially the same as or slightly less than the inner diameter of the rim 23 of the regulator cap 16. The base flange 38 has an outer annular enlargement 47 which tapers in width outwardly towards its outer periphery and which defines an inwardly directed shoulder 48 having an inner diameter substantially the same as the outer diameter of the rib 37 on the underside of the teat collar 17.

In use the regulator cap 16 is frictionally engaged with the mouth 15 of the bottle by pressing the cap 16 into the mouth 15 effecting engagement between the rib 24 and inner surface 14 of the threaded neck 13 surrounding the mouth 15. The teat 18 is coupled with the teat collar 17 so that the main teat body 39 protrudes through the opening 35 in the teat collar 17 with the top wall 34 of the teat collar 17 and rib 37 being captured within the recess 41, the collar 40 being pushed from the lower side of the teat collar 17 through the opening 35 to locate on the upper side thereof.

When the teat 18 is coupled to the teat collar 17, the rib 37 spaces the annular base flange 38 from the underside surface of the top wall 34 of the teat collar 17 as shown in FIG. 9. The annular flange 38 can thus flex about the rib 37 in the nature of a flap member of a flap valve. The rib 37 also abuts the shoulder 38 of the base flange.

The teat collar 17 is then screwed onto the bottle neck 13 through engagement between the cooperating threads 29 and 30. When the teat collar 17 is engaged with the bottle 10, the lower surface of the base flange 38 of the teat 18 seats on the rim 23. The flanges 26 additionally project into the teat body 39 with the outer side edges 46 of the flanges 26 which extend substantially parallel to the central axis of the closure assembly 11 being located adjacent to the inner surface of the teat body 39 adjacent the annular groove 42.

In the position of FIGS. 8 and 9, the teat collar 17 is rotated relative to the regulator cap 16 to a maximum open position determined by abutment between the stop members 31 on the teat collar 17 and stop members 33 on the bottle 10. In this position, the central dome 21 which normally blocks and seals the entrance 42 into the teat body 39 is spaced from and clear of the entrance 42. Thus fluid is able to pass from the bottle 10 through one or more of the slots 22 in the regulator cap 16 and into the upper chamber 43 in the teat body 39 as indicated by the arrows marked B in FIG. 8 and then out through the teat outlet or outlets 45 when the bottle 10 is inverted or when a suction pressure is applied to the teat nozzle 44.

As fluid is withdrawn through the outlet or outlets 41 a partial vacuum is created inside the teat body 39 and thus within the bottle 10 and therefore there is a tendency for air from the outside environment to try and enter through any opening that is available. Normally this would be the outlet or outlets 45. Air however is able to be drawn into the closure assembly 11 between the threads 29 and 30 in a direction indicted by the arrow C in FIG. 9 and pass between the teat collar skirt or side wall 27 and neck 13 of the bottle 10. Air will pass between the rim 23 and base flange 38 and between the rib 36 and rim 23 with the rib 36 flexing slightly inwardly as indicated by the dotted lines in FIG. 9 away from the rim 23 due to the suction pressure. The air will then pass down any of the apertures 22 in the regulator cap 16 to replace fluid which leaves the bottle 10 and passes out through the outlet or outlets 45 in the nozzle 44.

Therefore only fluid tends to flow through the outlet or outlets 45 with air passing between the base flange 38 and regulator cap 16 and down an aperture 22 because this provides a lower path of resistance to its entry than through the outlet or outlets 45. When fluid is being withdrawn through the outlet or outlets 45 by, for example, a sucking action, the flange 46 is able to move or flex slightly away from the rim 23 so that air can more easily enter the bottle 10 through one or more of the apertures 22. Similarly the base flange 38 will flex slightly away from the upper edge of the rim 23 to allow air entry. When a suction pressure is not applied to the teat nozzle 44, the rib 46 will seal against the rim 23 or sufficiently close to the rim 23 to prevent escape of liquid from the bottle 10 even when the bottle 10 is inverted or dropped.

As the flanges 26 on the upper side of the dome 21 project into the teat 18 and the side edges 46 of the flanges 26 are positioned close to the inner surface of the main body 39 of the teat 18 in the region of the annular groove 41 adjacent to the opening 35 through which the teat 18 projects, the risk of detachment of the teat 18 from the teat collar 17 (for example when a baby is drinking from the bottle carrying the closure assembly 11) is substantially reduced as the distance between the edges 46 of the flanges 26 and opposing edge of the opening 35 of the collar 17 will prevent the teat 18 being pulled out of the collar 17. At the same time, the configuration of the flanges 26 does not reduce the flow of liquid through the nozzle 44.

When it is desired to close the closure assembly 11, the teat collar 17 is simply rotated relative to the regulator cap 16 in an opposite direction to that for opening the closure assembly 11 due to the cooperation between the threads 29 and 30 on the inner side of the regulator cap 17 and neck 13. When this occurs, the top wall 34 of the teat collar 17 moves relatively towards the top wall 19 of the regulator cap 16. The rib 37 on the teat collar 17 will thus push the teat flange 38 downwardly and the rim 23 will push the outer periphery of the flange 38 upwardly towards the underside surface of the top wall 34. This causes the rib 46 to be outwardly deflected and forced firmly against the inner surface of the rim 23. Furthermore the dome 21 moves into the entrance 42 into the teat body 39 and seals it off. The flange 38 is thus sandwiched between the rim 23 of the regulator cap 16 and rib 37 on the underside of the top wall 34 to be effectively clamped between the rim 23 and rib 37 to hold the teat 18 in position to prevent or reduce the possibility of its detachment from the teat collar 17 as well as defining a seal preventing air entry into the bottle 10.

The closure assembly 11 described above provides an effective means for opening and closing a baby's bottle to allow or prevent passage of fluid from the baby's bottle through outlet or outlets 45. In addition the described configuration allows air to enter the bottle to replace fluid dispensed from the bottle 10 to limit if not prevent air entering through the outlet or outlets 45.

Where it is desired to detach the teat collar 17 from the bottle 10, an increased rotational force is applied to the teat collar 17 to force the stop members 31 on the teat collar 17 past the stop members 33 on the bottle neck 13, this being facilitated by the curved or domed configuration of the stops 31 and 33 allowing one stop member to ride up over the other opposite stop member. A reverse procedure is adopted to reattach the teat collar 17 to the bottle 10.

The flanges 26 whilst shown to be of a cruciform configuration may be other configurations. For example three flanges extending at 120 degrees to each other may be provided. Alternatively only two flanges 26 or a single diametrically extending flange 26 may be used. Alternatively more than four flanges 26 may be provided. The flanges 26 alternatively may be replaced by one or a series of members extending or spaced circumferentially around the regulator cap 16 to be located in use adjacent the inner surface of the teat 1 body 39 adjacent the mouth 42.

It will be appreciated that the regulator cap 16 and teat collar 17 may be in various configurations. Similarly the teat 18 may be of a shape and form other than that illustrated in the drawings.

Whilst the underside of the collar top wall 34 is provided with an annular rib 37, in an alternative embodiment, the rib 37 may be removed and replaced by a rib on the upper side of the base flange 38 of the teat 18.

The terms "comprising" or "comprises" or derivatives thereof as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as defined in the appended claims.

The invention claimed is:

1. A closure assembly for a baby's bottle having an open outlet mouth, said closure assembly comprising:

a regulator cap adapted to be engaged with the mouth of said bottle to secure said cap to said bottle and substantially close said mouth, said regulator cap having one or more apertures therein for flow of fluid from said bottle and air into said bottle, a teat collar positioned over the regulator cap, said teat collar having a side wall or skirt, said side wall having a thread on its inside surface for cooperation with an external thread on the bottle adjacent the mouth of the bottle, said collar further including a top wall having a central opening, and stop means for limiting rotation of said teat collar relative to said bottle, said stop means comprising an inwardly directed stop member or members on the inside of the side wall or skirt of the teat collar and an outwardly directed stop member on said bottle, respective stop members on said collar and said bottle being adapted to abut each other when the teat collar has been rotated a predetermined distance relative to said bottle to define open and/or closed positions respectively of the closure assembly, and a teat projecting through said central opening in said top wall of the teat collar and having an outlet for passage of fluid, said teat having a flexible base flange, and wherein in said first position of said teat collar, fluid can pass through one or more said apertures in the regulator cap and through said teat outlet with air flowing from externally of the bottle and past said base flange into said bottle through one or more said apertures in the regulator cap when a suction pressure is applied to said teat, and wherein when said teat collar is in said second position, said base flange is compressed against said regulator cap to prevent air from passing into said bottle and fluid is substantially prevented from passing from the bottle through said one or more apertures in the regulator cap into the teat.

2. The closure assembly as claimed in claim 1 wherein said regulator cap includes an annular rib on its underside which is receivable within the mouth of the bottle to frictionally engage the inner surface of said bottle mouth.

3. The closure assembly as claimed in claim 1 wherein said stop means on said collar comprise a pair of spaced stop members and wherein in use abutment between respective said spaced stop members on said collar and said stop member on said bottle defines said open and closed positions of said closure assembly.

4. The closure assembly as claimed in claim 1 wherein said teat includes a main hollow central body and wherein said base flange is located at the base of the body, said regulator cap being adapted to project into an entrance into the hollow central body of the teat in said second closed position of the closure assembly.

5. The closure assembly as claimed in claim 4 wherein said regulator cap includes a central plug which extends into and sealingly closes the entrance of said teat body in said closed position of said closure assembly.

6. The closure assembly as claimed in claim 4 wherein said regulator cap includes a flange or flanges adapted to restrict detachment of the teat from the teat collar, said flange or flanges extending to a position adjacent to an inner surface of the teat body.

7. The closure assembly as claimed in claim 4 wherein said teat base flange has an annular sealing rib on its underside and wherein said regulator cap includes an annular rim on its upper side adapted for cooperation around its periphery with said annular sealing rib, said sealing rib being adapted to permit air to enter said bottle between said rib and rim upon suction pressure being applied to said bottle through said teat.

8. The closure assembly as claimed in claim 7 wherein in said closed position of said closure assembly, said annular sealing rib of said teat base flange is forced by said teat collar into sealing engagement with the rim of said regulator cap.

9. The closure assembly as claimed in claim 7 wherein said base flange seats on said annular rim and wherein air is able to pass between the base flange and rim upon a suction pressure being applied to the teat in said open position of the closure assembly.

10. The closure assembly as claimed in claim 9, wherein in said closed position of said closure assembly, the base flange of the teat is forced by said teat collar into sealing engagement with the said annular rim of the regulator cap.

11. A closure assembly for a baby's bottle an outlet or mouth, said closure assembly comprising:

a regulator cap, said regulator cap having an upper side and a lower side and a plurality of circumferentially spaced apertures therein, said lower side having an annular rib adapted to be a push or press fit into said outlet or mouth of said bottle to frictionally secure said regulator cap to said bottle, said regulator cap further having an outer annular rim on its upper side, a teat collar locatable over the regulator cap, said teat collar having a side wall or skirt, said side wall or skirt having a thread on its inside surface for cooperation with an external thread on the bottle adjacent the mouth of the bottle, said teat collar being rotatable between first and second positions comprising open and closed positions respectively of said closure assembly, and a teat coupled to the teat collar, said teat having a main hollow body and an outlet for passage of fluid, said teat further having a flexible base flange adapted to seat on said rim of said regulator cap, said regulator cap including flanges extending radially to a position adjacent to an inner surface of the teat body to restrict detachment of the teat from said teat collar, and wherein when said closure assembly is in said open position, fluid can pass through one or more said apertures in said regulator cap and through said teat outlet and air can pass between said skirt of said teat collar and said bottle and past said base flange and into said bottle through one or more said apertures in the regulator cap, and wherein when said closure assembly is in said closed position, fluid is substantially prevented from passing from said one or more apertures in said regulator cap into the said teat and air is prevented from flowing past said base flange into said bottle.

12. A closure assembly for a baby's bottle having an open outlet mouth, said closure assembly comprising:

a regulator cap adapted to be engaged with the mouth of said bottle to secure said cap to said bottle and substantially close said mouth, said regulator cap having one or more apertures therein for flow of fluid from said bottle and air into said bottle, a teat collar positioned over the regulator cap, said teat collar being moveable between first and second positions comprising open and closed positions respectively of the closure assembly, and a teat coupled to the teat collar, said teat including a main hollow central body and having an outlet for passage of fluid, said teat having a flexible base flange located at the base of the teat body, said regulator cap including a flange or flanges adapted to restrict detachment of the teat from the teat collar, said flange or flanges extending radially to a position adjacent to an inner surface of the teat body, and wherein in said first open position of said teat collar, fluid can pass through one or more said apertures in the regulator cap and through said teat outlet with air flowing externally from the bottle and past said base flange into said bottle through one or more said apertures in the regulator cap when a suction pressure is applied to said teat, and wherein when said teat collar is in said second closed position, said base flange is compressed against said regulator cap to prevent air from passing into said bottle and said regulator cap projects into and closes an entrance into the hollow central body of the teat in said second closed position of the closure assembly to prevent fluid passing from said bottle through said one or more apertures in the regulator cap into the teat.

13. The closure assembly as claimed in claim 12 and including stop means on the teat collar adapted to cooperate with stop means on said bottle to limit in use rotation of the teat collar relative to said bottle and define said open and closed positions of said closure assembly.

14. A closure assembly as claimed in claim 12, wherein said regulator cap has an upper side and a lower side, said lower side having an annular rib adapted to be a push or press fit into said outlet mouth of said bottle to frictionally secure said regulator cap to said bottle, said regulator cap further having an outer annular rim on its upper side.

15. The closure assembly as claimed in claim 14 wherein said base flange includes an annular sealing rib on its underside adapted to cooperate peripherally with the radially inner side of the rim of the regulator cap.

16. The closure assembly as claimed in claim 15 wherein said teat collar includes a top wall having a central opening through which said teat projects, said teat being captured to said teat collar, an annular rib on the underside of said top wall adapted to engage said teat base flange inwardly of said rim and deflect said teat base flange in said closed position of said closure assembly to urge said base flange against said rim and said sealing rib of said base flange against the inner surface of said rim.

17. The closure assembly as claimed in claim 16 wherein said teat includes an entrance leading into said hollow body, the regulator cap including a central plug adapted in the closed position of said closure assembly to extend into said teat entrance to close the entrance into the teat body.

18. A closure assembly for a baby's bottle having an open outlet or mouth and an external thread adjacent said mouth, said closure assembly comprising:

a regulator cap adapted to be engaged with said bottle to secure said cap to said bottle and substantially close said mouth, said regulator cap having a top wall having a central plug or dome and an outer annular wall portion, a plurality of circumferentially spaced apertures in said annular wall portion for flow of fluid from said bottle and air into said bottle, and an outer upstanding annular rim having an upper edge and an inner side surface, a teat collar positioned over the regulator cap, said teat collar having a top wall and a side wall or skirt extending from said top wall, said top wall having a central opening therein, said side wall or skirt having an internal thread adapted for cooperation with said external thread on said bottle whereby said teat collar is rotatable between first and second positions comprising open and closed positions respectively of the closure assembly, and a teat extending through said central opening in said teat collar and having an outlet for passage of fluid, said teat having a main hollow central body and a flexible base flange seating on the upper edge of said rim of said regulator cap, said base flange having a downwardly extending annular sealing rib located inwardly of said annular rim for sealing engagement with said inner side surface of said annular rim, said central plug or dome of said regulator cap being adapted to project into an entrance into the hollow central body of the teat for sealing engagement therewith in said second closed position of the closure assembly, and wherein when said teat collar is rotated to said first open position, said central plug or dome is moved out of sealing engagement with said entrance of said teat body whereby fluid can pass through one or more said apertures in the regulator cap and through said teat outlet and air can flow externally from the bottle and past said base flange into said bottle through others of said apertures in the regulator cap, and wherein when said teat collar is rotated to said second closed position, said central plug or dome is moved into sealing engagement with said entrance into said teat body whereby fluid is prevented from passing from the bottle through said one or more apertures in the regulator cap into the teat and said base flange is forced downward by said teat collar into sealing engagement with the upper edge of said annular rim and said downwardly extending annular sealing rib of the base flange of said teat is forced into sealing engagement with said inner side surface of said rim of said regulator cap to prevent air from passing into said bottle.

19. The closure assembly as claimed in claim 18, further and including stop means on the teat collar adapted to cooperate with stop means on said bottle to limit in use rotation of the teat collar relative to said bottle and define said open and closed positions of said closure assembly.

20. The closure assembly as claimed in claim 18, wherein said regulator cap includes a flange or flanges adapted to restrict detachment of the teat from the teat collar, said flange or flanges extending to or being positioned adjacent to an inner surface of the teat body.

* * * * *